US008474115B2

(12) United States Patent
Huff et al.

(10) Patent No.: US 8,474,115 B2
(45) Date of Patent: Jul. 2, 2013

(54) APPARATUS AND METHOD FOR MAKING LOW TANGLE TEXTURIZED ROVING

(75) Inventors: Norman T. Huff, Brighton, MI (US); Janakikodandaram Karra, Novi, MI (US); Gareth Knoll, Northville, MI (US); Mark A. Friedrich, Georgetown, IN (US)

(73) Assignee: OCV Intellectual Capital, LLC, Toledo, OH (US)

( * ) Notice: Subject to any disclaimer, the term of this patent is extended or adjusted under 35 U.S.C. 154(b) by 303 days.

(21) Appl. No.: 12/549,601

(22) Filed: Aug. 28, 2009

(65) Prior Publication Data

US 2011/0047768 A1 Mar. 3, 2011

(51) Int. Cl.
*D02G 1/16* (2006.01)
*B65H 54/76* (2006.01)

(52) U.S. Cl.
USPC ..... 28/271; 28/247; 28/289

(58) Field of Classification Search
USPC ..... 28/247, 289, 290, 291, 250, 271, 28/273, 274, 267, 258, 254; 19/304, 299; 226/97.2, 97.4, 97.1, 7; 65/438, 475, 476, 65/478, 504, 505, 524
See application file for complete search history.

(56) References Cited

U.S. PATENT DOCUMENTS

| | | | | |
|---|---|---|---|---|
| 2,415,075 A | | 2/1947 | Abbott | |
| 2,741,009 A | | 4/1956 | Slayter et al. | |
| 2,851,737 A | | 9/1958 | Hunter et al. | |
| 2,982,082 A | | 5/1961 | Pool | |
| 3,054,714 A | | 9/1962 | Johnston | |
| 3,276,931 A | | 10/1966 | Rees | |
| 3,281,913 A | * | 11/1966 | Morehead et al. | 53/430 |
| 3,295,162 A | | 1/1967 | Forceville | |
| 3,340,684 A | | 9/1967 | Shichman | |
| 3,351,992 A | | 11/1967 | Carter | |
| 3,381,346 A | | 5/1968 | Benson | |
| 3,471,911 A | | 10/1969 | Nechvatal et al. | |
| 3,509,687 A | * | 5/1970 | Fleissner | 53/116 |
| 3,577,614 A | | 5/1971 | Price | |

(Continued)

FOREIGN PATENT DOCUMENTS

| | | |
|---|---|---|
| DE | 3527415 | 2/1987 |
| DE | 4444917 | 6/1996 |

(Continued)

OTHER PUBLICATIONS

Partial International Search Report from PCT/US10/046645 dated Oct. 18, 2010.

(Continued)

*Primary Examiner* — Amy Vanatta
(74) *Attorney, Agent, or Firm* — Calfee, Halter & Griswold LLP

(57) ABSTRACT

A method of collecting a strand using an air stream dissipater comprises texturizing the strand with an air stream on a first side of the air stream dissipater, directing the texturized strand through the air stream dissipater and collecting the texturized strand in a container on the second side of the air stream dissipater. A system for texturizing a strand comprises a texturizer for texturizing the strand with an air stream, a container to collect and hold the texturized strand and an air stream dissipater provided between the texturizer and the container to dissipate excess air from the air stream and prevent the excess air from entering the container.

14 Claims, 5 Drawing Sheets

U.S. PATENT DOCUMENTS 3,580,445 A 5/1971 Moore, Jr.
3,593,395 A * 7/1971 Stanley ..... 28/221
3,613,830 A 10/1971 Hubbell
3,619,322 A 11/1971 Fleissner
3,714,686 A 2/1973 Schmid et al.
3,775,209 A 11/1973 Paquette et al.
3,802,038 A 4/1974 Bauch et al.
3,823,450 A 7/1974 Ankudowicz et al.
3,827,114 A 8/1974 Crossfield
3,832,759 A * 9/1974 Eskridge et al. ..... 28/255
3,847,522 A 11/1974 Heckrotte et al.
3,849,847 A * 11/1974 Corbiere ..... 28/218
3,912,479 A 10/1975 Roberson
3,951,321 A 4/1976 Heusser
3,955,643 A 5/1976 Clark
3,956,807 A * 5/1976 Holland ..... 28/255
3,968,877 A 7/1976 Mattis
4,024,698 A 5/1977 Weiss et al.
4,030,651 A 6/1977 Weiss et al.
4,033,741 A 7/1977 Drummond
4,069,566 A 1/1978 Sumitomo et al.
4,085,881 A 4/1978 Roberson
4,098,444 A 7/1978 Cole
4,148,179 A * 4/1979 Becker et al. ..... 57/350
4,185,064 A 1/1980 Schippers
4,188,691 A * 2/1980 Matsumoto et al. ..... 28/255
4,215,805 A 8/1980 Nielsen
4,217,159 A 8/1980 Ellis et al.
4,285,452 A 8/1981 Reba et al.
4,298,153 A 11/1981 Stables et al.
4,401,610 A 8/1983 Ohberg
4,422,225 A 12/1983 Kurzke
4,470,252 A 9/1984 Brodmann
4,543,690 A 10/1985 Potters
4,554,716 A * 11/1985 Nunn ..... 28/263
4,569,471 A 2/1986 Ingemansson et al.
4,609,519 A 9/1986 Pichard et al.
RE32,258 E 10/1986 Kondo et al.
4,631,791 A 12/1986 Symon
4,631,912 A 12/1986 Hardy
4,667,864 A 5/1987 Kiteck
4,724,588 A 2/1988 Runkel
4,741,151 A 5/1988 Klink et al.
4,774,985 A 10/1988 Broadbelt et al.
4,776,162 A 10/1988 Glaser et al.
4,817,880 A 4/1989 Lenk et al.
4,829,640 A 5/1989 Greb et al.
4,860,407 A 8/1989 Roess
4,898,770 A 2/1990 Dunbar
4,932,108 A 6/1990 Brodmann
4,952,366 A 8/1990 Gelin
4,958,173 A 9/1990 Fitch et al.
4,961,700 A 10/1990 Dunbar
4,968,578 A 11/1990 Light et al.
5,009,941 A 4/1991 Pollet et al.
5,011,523 A 4/1991 Roncato et al.
5,020,199 A 6/1991 Gorrafa
5,024,890 A 6/1991 Pollet et al.
5,025,533 A 6/1991 Faas et al.
5,026,410 A 6/1991 Pollet et al.
5,034,181 A 7/1991 Billiu
5,041,260 A 8/1991 Johnson et al.
5,051,123 A 9/1991 Nurmi
5,076,393 A 12/1991 Howerton et al.
5,092,122 A 3/1992 Bainbridge
5,104,731 A 4/1992 Gager
5,142,327 A 8/1992 Kahle
5,146,052 A 9/1992 Dummel
5,187,845 A * 2/1993 Duffy et al. ..... 28/267
5,220,137 A 6/1993 Howerton et al.
5,256,366 A 10/1993 Wejrock et al.
5,281,778 A 1/1994 Cheladyn et al.
5,293,676 A 3/1994 Geirhos et al.
5,316,601 A 5/1994 Hebbard et al.
5,326,009 A 7/1994 Kobayashi et al.
5,368,623 A 11/1994 Hirschmann et al.
5,379,806 A 1/1995 Matthews et al.
5,398,407 A 3/1995 Stuer
5,418,339 A 5/1995 Bowen et al.
5,461,777 A 10/1995 Ikeda et al.
5,479,706 A 1/1996 Tamano et al.
5,487,412 A 1/1996 Matthews et al.
5,688,301 A 11/1997 Brandon et al.
5,688,594 A 11/1997 Lichscheidt et al.
5,766,541 A 6/1998 Knutsson et al.
5,792,555 A 8/1998 Bak et al.
5,846,637 A 12/1998 Malhotra et al.
5,879,800 A 3/1999 Geirhos
5,910,361 A 6/1999 Guevel et al.
5,976,453 A * 11/1999 Nilsson et al. ..... 264/555
6,013,223 A 1/2000 Schwarz
6,029,897 A 2/2000 Jander
6,032,844 A * 3/2000 Hartzog et al. ..... 226/97.4
6,094,817 A 8/2000 Shah et al.
6,109,016 A 8/2000 Geirhos
6,131,785 A 10/2000 Anderson et al.
6,148,519 A 11/2000 Stenersen et al.
6,158,547 A 12/2000 Ackermann et al.
6,189,344 B1 * 2/2001 Aschenbeck et al. ..... 65/441
6,217,708 B1 4/2001 Kurihara et al.
6,317,959 B1 11/2001 Nilsson et al.
6,370,747 B1 4/2002 Lewin et al.
6,715,191 B2 4/2004 Adzima et al.
7,147,909 B2 12/2006 Nair
7,211,363 B2 5/2007 Jones
7,624,867 B2 12/2009 Lewin et al.
7,687,136 B2 3/2010 Nair
7,754,315 B2 7/2010 Nair
7,867,603 B2 1/2011 Dontula
2002/0037176 A1 3/2002 Ogino et al.
2002/0058194 A1 5/2002 Williams et al.
2002/0083566 A1 * 7/2002 Reinehr et al. ..... 28/289
2003/0000055 A1 1/2003 Adzima et al.
2003/0082354 A1 5/2003 Nakamura et al.
2003/0082473 A1 5/2003 Nakamura et al.
2003/0141487 A1 7/2003 Lelental et al.
2003/0175484 A1 9/2003 Shirokura et al.
2003/0186061 A1 10/2003 Murata et al.
2003/0224192 A1 12/2003 Tani et al.
2003/0234846 A1 12/2003 Koga et al.
2003/0235683 A1 12/2003 Tamagawa et al.
2004/0058176 A1 3/2004 Nakamura et al.
2004/0248028 A1 12/2004 Tamagawa et al.
2006/0115627 A1 6/2006 Dontula et al.
2006/0115630 A1 6/2006 Zaretsky et al.

FOREIGN PATENT DOCUMENTS

EP 156600 10/1985
EP 446064 9/1991
EP 485328 5/1992
EP 615014 9/1994
EP 692616 1/1996
EP 1336901 8/2003
FR 2544777 10/1984
GB 1419810 12/1975
GB 2158001 11/1985
JP 55-137207 10/1980
JP 2000-003060 1/2000
WO 96/01389 1/1996
WO 98/24615 6/1998
WO 00/00685 1/2000
WO 00/49327 8/2000
WO 02/22928 3/2002
WO 03/002798 3/2003
WO 2011/025822 3/2011

OTHER PUBLICATIONS

International Search Report and Written Opinion from PCT/US10/046645 dated Dec. 20, 2010.

International Search Report from PCT/EP99/04344 dated Nov. 29, 1999.

International Search Report from PCT/US01/27583 dated Jun. 6, 2002.

International Preliminary Examination Report from PCT/US01/27583 dated Dec. 10, 2002.

International Search Report from PCT/US02/20194 dated Oct. 17, 2002.
International Preliminary Examination Report from PCT/US02/20194 dated Oct. 7, 2003.
Partial International Search Report from PCT/US10/46645 dated Oct. 18, 2010.
International Search Report and Written Opinion from PCT/US10/46645 dated Dec. 20, 2010.
Interview Summary from U.S. Appl. No. 09/251,250 dated May 24, 2001.
Notice of Allowance from U.S. Appl. No. 09/661,329 dated Dec. 13, 2001.
Office action from U.S. Appl. No. 10/066,954 dated Nov. 4, 2002.
Office action from U.S. Appl. No. 10/066,954 dated Apr. 30, 2003.
Advisory action from U.S. Appl. No. 10/066,954 dated Jul. 14, 2003.
Office action from U.S. Appl. No. 10/066,954 dated Oct. 21, 2003.
Office action from U.S. Appl. No. 10/066,954 dated Jun. 10, 2005.
Notice of Panel Decision from Pre-Appeal Brief from U.S. Appl. No. 10/066,954 dated Nov. 2, 2005.
Office action from U.S. Appl. No. 10/066,954 dated Jan. 10, 2006.
Office action from U.S. Appl. No. 10/066,954 dated Jun. 20, 2006.
Advisory action from U.S. Appl. No. 10/066,954 dated Aug. 29, 2006.
Notice of Panel Decision from Pre-Appeal Brief from U.S. Appl. No. 10/066,954 dated Dec. 1, 2006.
Examiner's Answer from U.S. Appl. No. 10/066,954 dated Jun. 29, 2007.
Decision on Appeal from U.S. Appl. No. 10/066,954 dated Apr. 1, 2009.
Decision on Request for Rehearing from U.S. Appl. No. 10/066,954 dated Aug. 5, 2009.
Notice of Allowance from U.S. Appl. No. 10/066,954 dated Oct. 13, 2009.
Office action from U.S. Appl. No. 09/106,670 dated Mar. 23, 1999.
Office action from U.S. Appl. No. 09/251,250 dated Apr. 11, 2000.
Office action from U.S. Appl. No. 09/251,250 dated Mar. 6, 2001.
Interview Summary from U.S. Appl. No. 09/251,250 dated May 31, 2001.
Notice of Allowance from U.S. Appl. No. 09/661,329 dated Dec. 12, 2001.
Written Opinion from PCT/EP00/01056 dated Oct. 4, 2000.
International Preliminary Examination Report from PCT/EP99/04344 dated Jul. 19, 2000.
International Search Report from PCT/EP00/01056 dated Jun. 5, 2000.
International Preliminary Examination Report from PCT/EPOO/01056 dated Jan. 17, 2001.
International Preliminary Examination Report from PCT/US01/27583 dated Aug. 21, 2002.
Office action from Chinese Application No. 99808121.3 dated Apr. 12, 2002 along with English translation of relevant portions of action.
English translation of relevant portions of Office action from Czech Republic Application No. PV 2000-4757 dated Jun. 19, 2001.
Notice of Allowance from U.S. Appl. No. 09/106,670 date Jul. 12, 1999.
Notice of Allowance from U.S. Appl. No. 09/251,250 dated Sep. 7, 2000.
Notice of Allowance from U.S. Appl. No. 09/251,250 dated Aug. 27, 2001.
Office action from U.S. Appl. No. 09/895,922 daetd Aug. 14, 2003.
Notice of allowance from U.S. Appl. No. 09/895,922 dated Jan. 26, 2004.
Office action from Australian Application No. 2001288791 dated Jul. 10, 2006.
Office action from Australian Application No. 49003/99 dated Jun. 15, 2001.
English translation of Relevant Portions of Office action from Brazilian Application No. PI 9911537-9 dated Feb. 19, 2008.
Office action from Canadian Application No. 2,334,320 dated Feb. 20, 2006.
Office action from Canadian Application No. 2,359,620 dated Sep. 20, 2006.
Office action from Korean Application No. 2000-7014974 dated Oct. 19, 2005.
Office action from Mexican Application No. 03/02135 dated May 19, 2006 along with English translation of relevant portions of action.

* cited by examiner

APPARATUS AND METHOD FOR MAKING LOW TANGLE TEXTURIZED ROVING

TECHNICAL FIELD AND INDUSTRIAL APPLICABILITY OF THE INVENTION

This invention relates generally to the bulk collection of texturized strand and, more particularly, to a method and apparatus for the bulk collection of texturized strand.

BACKGROUND OF THE INVENTION

This invention relates to the bulk collection of strand, and in particular, to the bulk collection of texturized strand. A strand of glass filaments is typically formed by attenuating molten glass through a plurality of orifices in a bottom plate of a bushing. The filaments are attenuated by applying tensile forces to the streams of glass, so as to attenuate the streams. The filaments are coated with a sizing or binder material. The composition of the sizing material is tailored to the end use of the filaments. For example, if the filaments are to be used to reinforce an epoxy based composite then the sizing is formulated to be compatible with the particular epoxy. In this particular application, the sizing is tailored to provide the required lubricity, abrasion resistance, and integrity to the strand as it is processed in texturizing equipment while at the same time allowing for easy texturization of the strand in the texturization unit. The glass filaments are sized with the sizing material substantially immediately after they are formed. The filaments are gathered in parallel relationship to form a strand.

In conventional filament forming systems, the streams of glass have been attenuated by winding the filaments on an exterior of a rotating tube. The strand of filaments is wound on the tube as a cylindrical package. The winding device with the rotating tube pulls the filaments and collects the strand.

Instead of winding the strand around a rotating tube, the strand may be gathered into a container. The strand is typically collected in a container when it is attenuated by a pulling device such as mating wheels or a pair of belts. A bulk collection of strand can be easily shipped and used in subsequent processes.

Texturized strand is continuous strand that has been expanded or texturized. The fibers in the strand are separated to give the strand a full, wool-like appearance. Texturized strand dissipates air borne acoustic waves and also possesses good thermal insulative properties. Texturized strand is typically used in sound absorbers.

As the texturized strand is delivered into the box, excess air from the texturizing process tends to blow the strand around in the box during the filing process. This produces the conditions that result in tangles as the texturized strand is being pulled out of the box for subsequent processing.

Attempts have been made in the past to limit or eliminate the tangling problem. One such attempt is disclosed in U.S. Pat. No. 6,370,747 to Lewin et al. This patent discloses a method wherein texturized strand is directed into a four sided box with both the top and bottom of the box open. More specifically, the box is filled by directing the texturized strand down into the box though the open top. The bottom of the box opens into a screen covering a low air pressure chamber. The open bottom of the box allows the air to escape from the box quickly thereby significantly reducing the billowing of the strand in the box and, therefore, the formation of tangles when the strand is subsequently pulled from the box for processing.

Unfortunately, as the texturized strand or roving collects on the screen, the airflow resistance through the deposited strands increases. This results in less and less of the air being removed from the box by the low pressure chamber below the screen. Once the texturized strand or woven thickness on the screen exceeds about 10 to 15 centimeters (the thickness depends upon the pressure in the low pressure chamber), the amount of air removed from the box becomes so small that the strand is blown around in the box producing conditions that are known to cause strand tangling.

The current invention relates to a new and improved method and apparatus for eliminating the conditions that tend to cause the tangling of a texturized strand as it is removed from a box or container for further processing.

SUMMARY OF THE INVENTION

In accordance with the purposes of the present invention as described herein, an improved method is provided for collecting a strand using an air stream dissipater. The method comprises: (a) texturizing the strand with an air stream on a first side of the air stream dissipater; (b) directing the texturized strand through the air stream dissipater; and (c) collecting the texturized strand in a container on a second side of the air stream dissipater. Advantageously, the air stream dissipater redirects excess air from the texturizing process away from the container thereby reducing the billowing and shifting of the strand in the container that result in tangles in the texturized strand when the texturized strand is subsequently pulled from the container.

In one possible embodiment, the directing step includes directing the texturized strand through an aperture in an air stream deflector. In another possible embodiment, the directing step includes directing the texturized strand through a perforated pipe. In yet another possible embodiment, the directing step includes directing the texturized strand through an aperture in an air stream deflector and a lumen of a perforated pipe.

In accordance with yet another aspect of the present invention, a system is provided for texturizing a strand. The system comprises: (a) a texturizer for texturizing a strand with an air stream; (b) a container to collect and hold the texturized strand; and (c) an air stream dissipater provided between the texturizer and the container to dissipate excess air from the air stream and prevent that excess air from entering the container.

In one possible embodiment, the dissipater is an air stream deflector including an aperture through which the texturized strand passes. The aperture may have a diameter of between about 2 and about 10 cm. The air stream deflector may extend at least 5 cm beyond an edge of the aperture.

In another possible embodiment, the dissipater comprises a pipe having a lumen through which the texturized strand passes. That lumen may have a diameter of between about 2 and about 12 cm. Further, the side wall of the pipe may be perforated to include between about 1 and about 90% open space to allow the dissipation of excess air as the texurized strand is directed into the container.

In still another possible embodiment, the dissipater comprises both the air stream deflector and the perforated pipe. The pipe may be pivotally mounted to the air stream deflector to permit the pipe to move in a first direction, and the air stream deflector may also be pivotally mounted to permit the pipe to move in a second direction, thereby allowing the pipe to move in an x-y pattern thereby promoting ordered layering of texturized strand in a box or container.

In accordance with yet another aspect of the present invention, a dissipater is provided. The dissipater comprises an air stream deflector including an aperture and a perforated pipe having a lumen in communication with that aperture.

In the following description there is shown and described several different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BEEF DESCRIPTION OF THE DRAWINGS

The accompanying drawings incorporated herein and forming a part of the specification, illustrate several aspects of the present invention and together with the description serve to explain certain principles of the invention. In the drawings.

Figure 1:
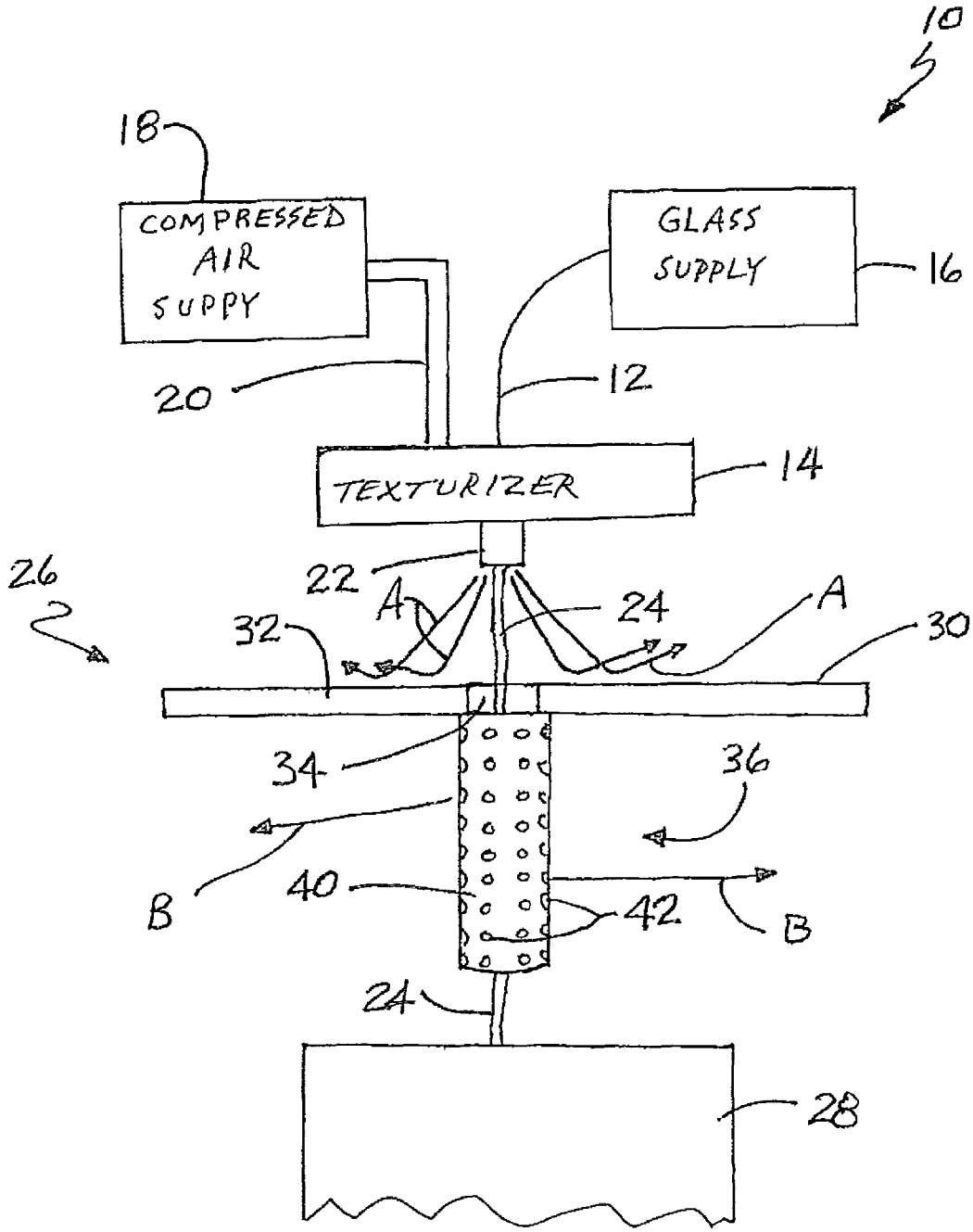
FIG. 1 is a schematical side clevational view of a system of the present invention for texturizing a strand according to at least one possible embodiment of the present invention.
Figure 2:
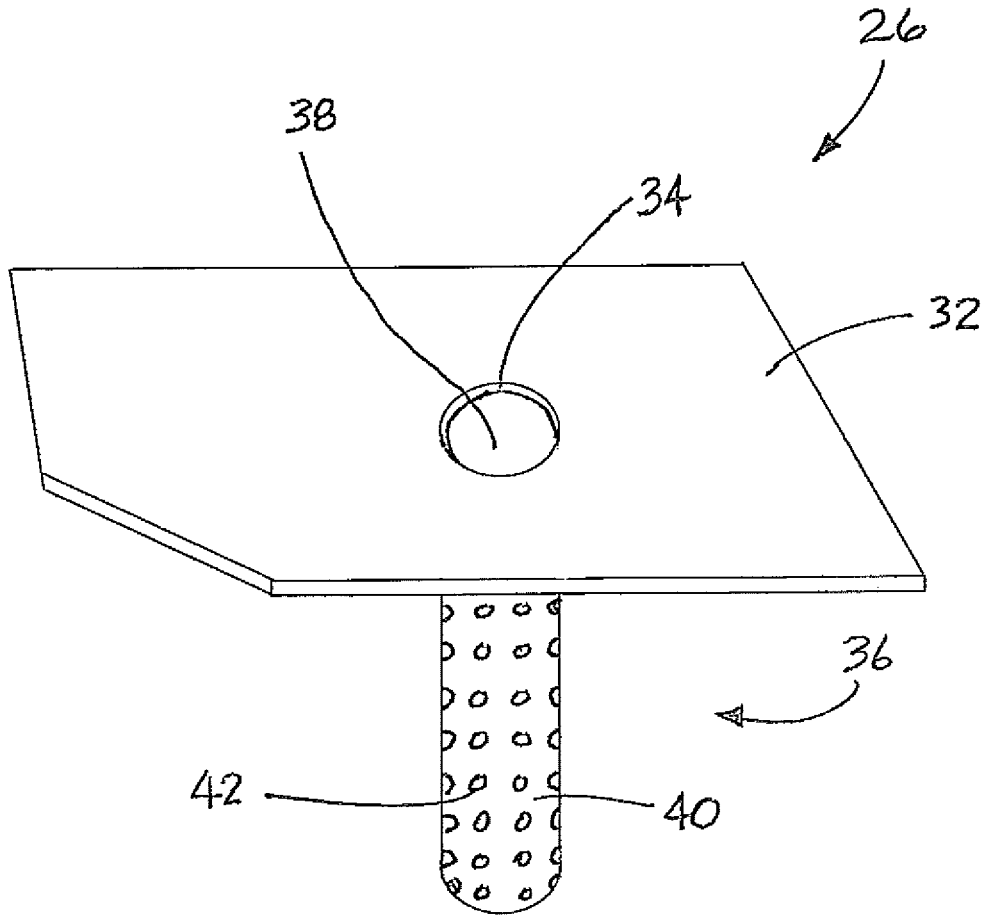
FIG. 2 is a perspective view of a dissipater suitable for use in the system.

Reference will now be made in detail to the present preferred embodiments of the present invention, examples of which are illustrated in the accompanying drawings.

DETAILED DESCRIPTION OF THE PREFERRED EMBODIMENTS OF THE INVENTION

Unless defined otherwise, all technical and scientific terms used herein have the same meaning as commonly understood by one of ordinary skill in the art to which the invention belongs. All references cited herein, including published or corresponding U.S. or foreign patent applications, issued U.S. or foreign patents, or any other references, are each incorporated by reference in their entireties, including all data, tables, figures, and text presented in the cited references. In the drawings, the thickness of the lines, layers, and regions may be exaggerated for clarity. It is to be noted that like numbers found throughout the figures denote like elements.

Reference is now made to FIG. 1 schematically illustrating the system 10 of the present invention for texturizing and collecting a strand of material. The continuous strand material 12 may comprise any conventional glass fiber strand. The terminology "glass fiber strand" as used herein shall mean a strand formed from a plurality of glass fibers in a parallel relationship. An example of such a strand is a commercially available roving having, for example, four thousand fibers. For muffler applications, glass fiber strands are preferred, as glass fibers are resistant to the high levels of heat produced in the interior of an engine exhaust muffler. Preferably, the strands are formed from E-glass or higher viscosity glass fibers. For industrial applications such as thermal insulation for chimney ducts or venting systems, glass fiber strands are also preferred. It is further contemplated, however, that the continuous strand material may comprise basalt fiber strands or fiber strands formed of other materials.

As best illustrated in FIG. 1, the system comprises a strand texurizer 14 of a type well known in the art such as disclosed and illustrated in U.S. Pat. No. 5,976,453 to Nilsson et al, owned by the assignee of the present invention. A glass supply 16 feeds continuous strand material 12 to the texturizer 14. A compressed air supply 18 feeds compressed air through the conduit 20. As the pressurized air and continuous strand material 12 pass through the nozzle 22 of the texturizer 14, the strand is texturized into a wool-type product referred to and shown as the texturized strand 24.

The texturized strand 24 is next directed through a dissipater, generally designated by reference numeral 26, before being delivered into a box or container 28 where it is held for delivery to a customer. Typically, the dissipater 26 or a portion of the dissipater such as the pipe 36, or the box/container 28 is moved in an x-y pattern to promote ordered layering of the texturized strand 24 in the box/container. Of course, it should be appreciated that other appropriate movement patterns could be used.

In the embodiment illustrated in FIG. 1, the dissipater 26 comprises an air stream deflector 30 including a planar body 32 and a central aperture 34. In addition, the dissipater 26 includes a pipe generally designated by reference numeral 36. The pipe 36 includes an internal lumen 38. In one possible embodiment, the side wall 40 of the pipe 36 incorporates a number of apertures or open spaces 42. Typically, the pipe 36 has a length of between about 4 and about 25 cm and more typically has a length of between about 8 and 15 cm.

Typically, the dissipater 26 is positioned between about 1 and about 40 cm from the texturizer 14 and, more particularly, the end of the nozzle 22. Typically the aperture 34 has a diameter of between about 2 and about 12 cm. Further, the air stream deflector 30 and, more particularly, the planar body 32, extends at least 5 cm and typically between about 10 and about 35 cm beyond the peripheral edge or margin of the aperture 34.

Typically the lumen 38 of the pipe 36 has a diameter of between about 2 and about 12 cm. Further, the side wall 40 of the pipe includes between about 1 and about 90% and more typically between about 15 and about 40% open space. In the illustrated embodiment, the apertures or perforations 42 in the side wall 40 are circular in shape. It should be appreciated, however, that those apertures may assume substantially any other shape that does not interfere with the passage of the texturized strand 24 through the perforated pipe 36 but allows excess air from the texturizing process to escape and dissipate outwardly away from the open container 28.

The method of the present invention of collecting a texturized strand 24 comprises the steps of (a) texturizing the strand 12 with an air stream on a first side of the air stream dissipater 26; (b) directing the texturized strand 24 through the air stream dissipater; and (c) collecting the texturized strand 24 in a container 28 on a second side of the air stream dissipater. As should be appreciated the air stream dissipater 26 and, more particularly, an air stream deflector 30 redirects excess air from the texturizing process away from the container 28 (see action arrows A in FIG. 1). Likewise, the apertures 42 in the pipe 36 allow excess air to dissipate outwardly away from the container 28 (see action arrows B). Advantageously, this reduces the tangles in the texturized strand 24 when the texturized strand is subsequently pulled from the container 28 by the customer for further processing.

Figure 3:
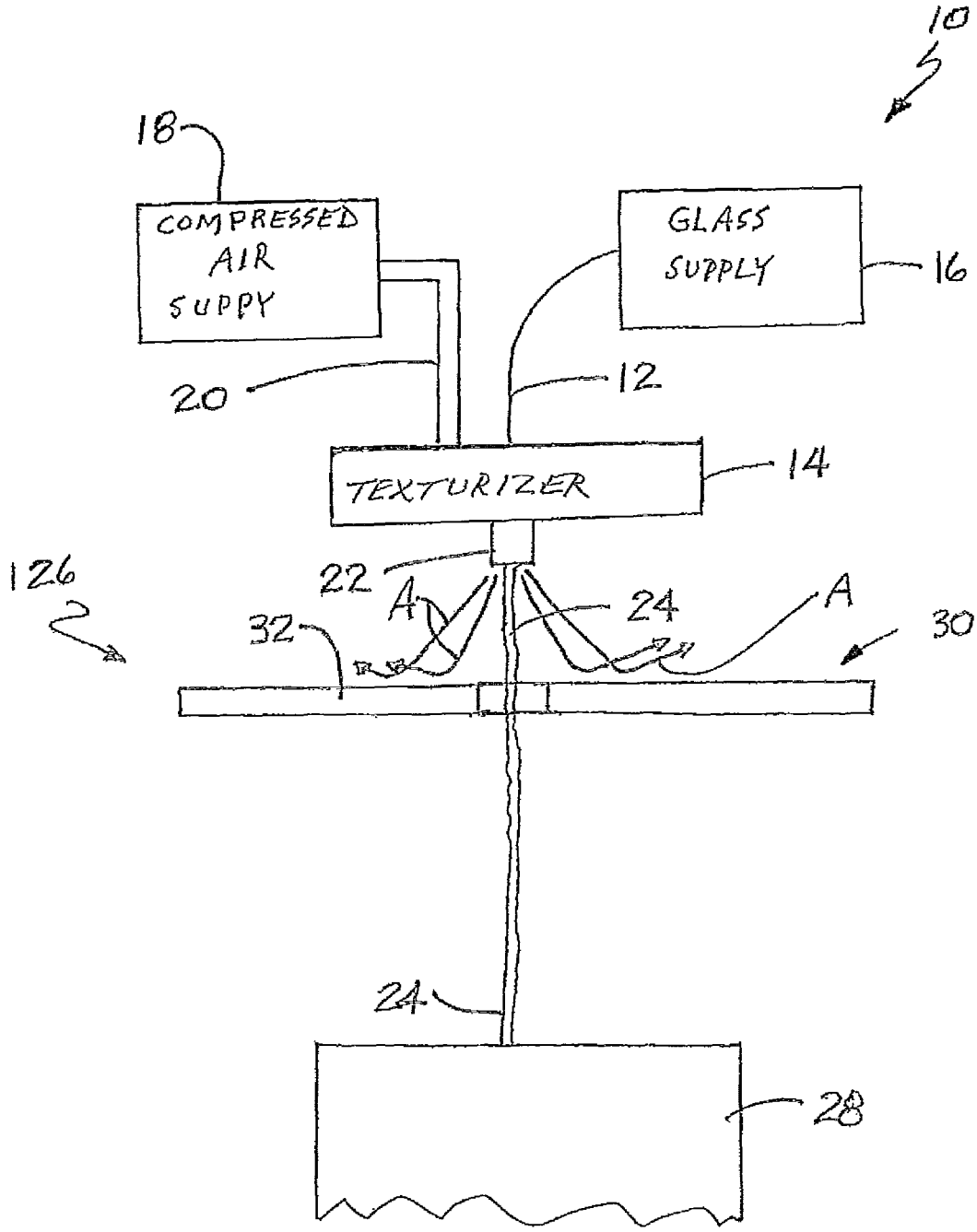
FIG. 3 is a schematical side elevational view of a system of the present invention for texturizing a strand according to a second possible embodiment of the present invention.
Figure 4:
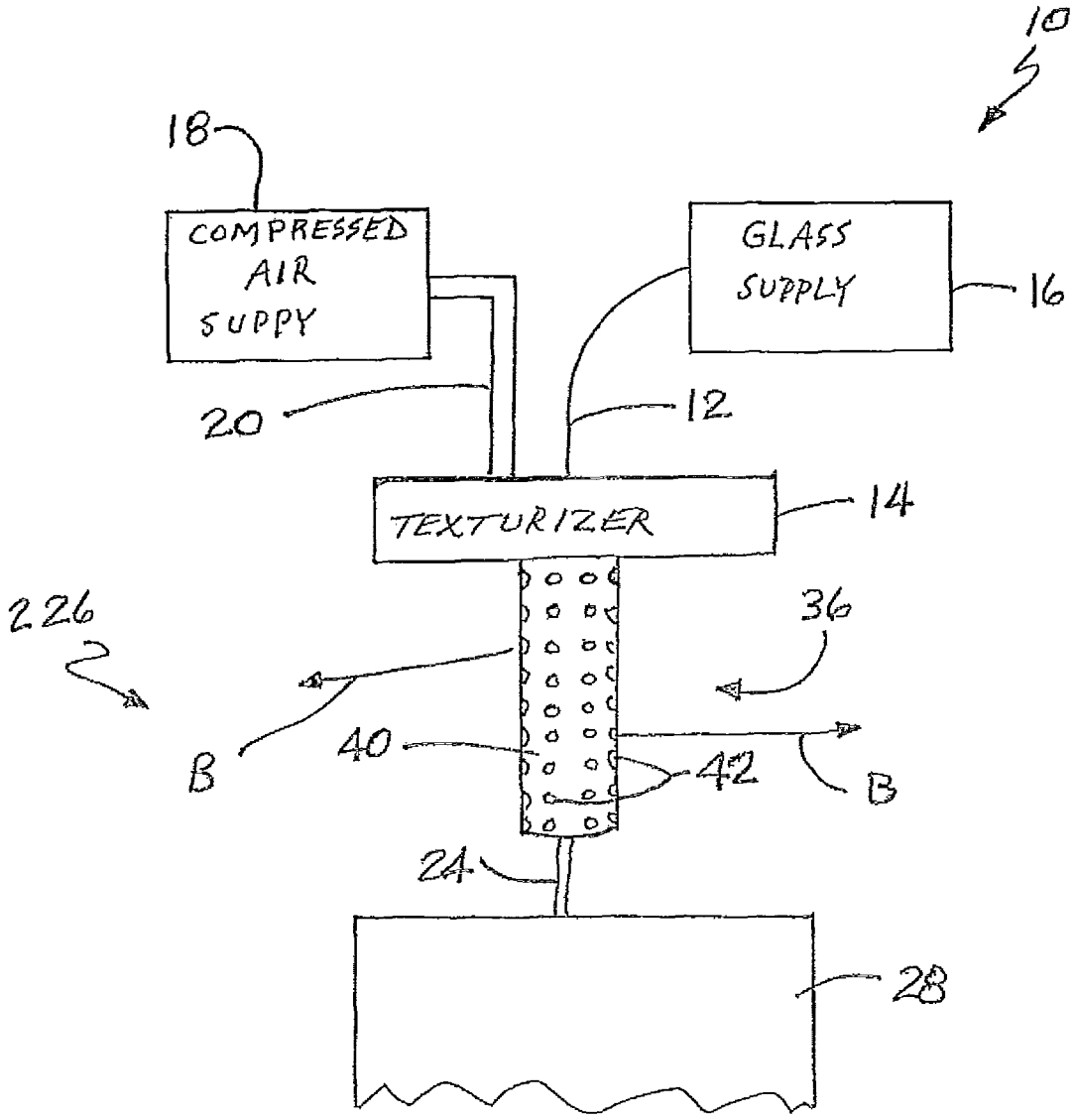
FIG. 4 is a schematical side elevational view of a system of the present invention for texturizing a strand according to a third possible embodiment of the present invention.

In the illustrated embodiment of FIG. 1, the dissipater 26 comprises both the air deflector 30 and a perforated pipe 36. It should be appreciated, however, that for certain applications the dissipater may comprise the air stream deflector 30 alone, shown as dissipater 126 in FIG. 3, or the perforated pipe 36 alone, shown as dissipater 226 in FIG. 4. For example, the perforated pipe 36 is particularly useful as a dissipater in relatively low-pressure applications where the continuous strand material 12 is only being texturized to a small degree. In these types of applications, it is possible that the end of the nozzle 22 and pipe 36 could be combined by placing perforations in nozzle 22 allowing the texturizing air to escape in a direction away from the strand.

Figure 5:
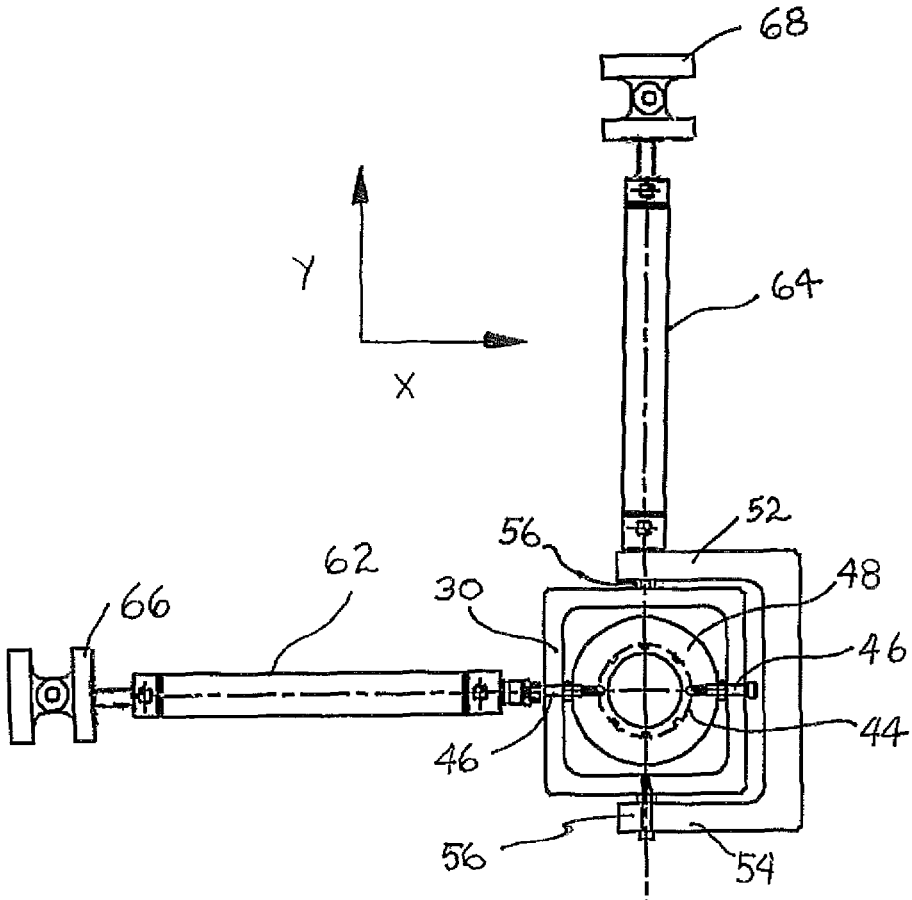
FIG. 5 is a top view of a system of the present invention for texturizing a strand according to a fourth possible embodiment of the present invention.
Figure 6:
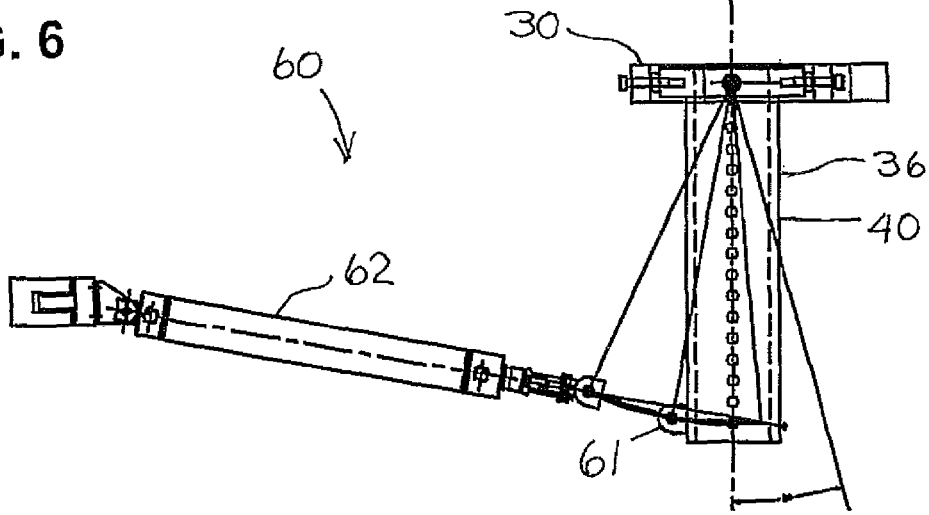
FIG. 6 is a side elevational view of the system of FIG. 5.

As noted above, a portion of the dissipater 26, such as the pipe 36, may be moved in an x-y pattern to promote ordered layering of the texturized strand 24 in the box/container. As shown in FIGS. 5 and 6, pipe 36 may be pivotally mounted to permit motion of pipe 36 in a first or y-direction. Pipe 36 may, for example, be pivotally mounted to air stream deflector 30 by means of a flange 48 disposed at an upper end of pipe 36. Flange 48 is pivotally connected to air stream deflector 30 by opposed flange shoulder bolts 46. Flange 48 may be integral with pipe 36, or may be attached to pipe 36, for example using a threaded connection 44.

As shown in FIG. 5, air stream deflector 30 may itself be pivotally mounted to permit motion of pipe 36 in second or x-direction. Air stream deflector 30 may, for example, be pivotally mounted to opposed arms 52, 54 by means of arm shoulder bolts 56.

Pivotally mounting both pipe 36 and air stream deflector 30, permits pipe 36 to move in an x-y pattern. Pipe 36 may be moved manually. Alternatively, pipe 36 may be moved using an automated positioning system 60.

As shown in FIGS. 5 and 6, automated positioning system 60 may include one or more air cylinders or pneumatic actuators. First and second actuators 62, 64 may be oriented at an angle to each other, for example perpendicular to each other, in a horizontal plane above the container to be filled. Each actuator 62, 64 is attached to pipe 36, for example using an associated clevis attachment bracket 61. Clevis attachment bracket 61 may be disposed along sidewall 40 near the bottom end of pipe 36.

Each actuator 62, 64 may be fitted with an associated proximity switch 66, 68, which reverses the motion of the associated actuator at a predetermined distance, thereby directing pipe 36 in a zig-zag motion in the x-y plane.

The foregoing description of the preferred embodiments of the present invention have been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. In some embodiments of the invention, certain features of the invention may be used to advantage without a corresponding use of other features. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A method of collecting a strand using an air stream dissipater including an air stream deflector and a perforated pipe, the method comprising:

texturizing the strand with an air stream on a first side of the air stream deflector, the air stream deflector including a planar body disposed substantially perpendicular to the texturized strand on the first side of the air stream deflector;

directing the texturized strand through an aperture in the air stream deflector to a second side of the air stream deflector;

passing the texturized strand through a lumen of the perforated pipe disposed on the second side of the air stream deflector, the perforated pipe being substantially perpendicular to the planar body of the air stream deflector and the lumen of the perforated pipe being in communication with the aperture in the air stream deflector; and collecting the texturized strand in a container on the second side of the air stream deflector, whereby the air stream dissipater redirects excess air after texturizing the strand away from the container thereby reducing tangles in the texturized strand when the texturized strand is subsequently pulled from the container.

2. The method of claim 1, wherein said directing step includes moving a portion of the dissipater in an x-y pattern to promote ordered layering of the texturized strand.

3. The method of claim 1, wherein said directing step includes moving the pipe in an x-y pattern to promote ordered layering of the texturized strand.

4. A system for texturizing a strand, comprising:

a texturizer for texturizing a strand with an air stream;

a container to collect and hold the texturized strand; and an air stream dissipater provided between the texturizer and the container to dissipate excess air from the air stream and prevent said excess air from entering the container, wherein the air stream dissipater includes an air stream deflector and a perforated pipe, wherein the air stream deflector includes a planar body disposed substantially perpendicular to the strand being texturized, wherein the planar body of the air stream deflector includes an aperture, wherein the perforated pipe is substantially perpendicular to the planar body of the air stream deflector, wherein a lumen of the perforated pipe is in communication with the aperture in the planar body of the air stream deflector, and wherein the texturized strand is operable to travel from the texturizer through the aperture in the planar body and through the lumen of the perforated pipe to the container, whereby the air stream dissipater redirects excess air after texturizing the strand away from the container.

5. The system of claim 4, further comprising means for moving said pipe in an x-y pattern.

6. A system for texturizing a strand, comprising:

a texturizer for texturizing a strand with an air stream;

a container to collect and hold the texturized strand; and an air stream dissipater provided between the texturizer and the container to dissipate excess air from the air stream and prevent said excess air from entering the container, wherein the air stream dissipater is an air stream deflector including an aperture through which said texturized strand passes, wherein said air stream dissipater further includes a perforated pipe having a lumen in communication with said aperture in said air stream deflector, and wherein said pipe is pivotally mounted to said air deflector to provide motion of said pipe in a first direction, and wherein said air deflector is pivotally mounted to provide motion of said pipe in a second direction.

7. The system of claim 6, further comprising:

a first actuator connected to said perforated pipe and configured to move said perforated pipe in a first direction;

a second actuator connected to said perforated pipe and configured to move said perforated pipe in a second direction perpendicular to said first direction; and a proximity switch associated with each actuator, wherein said actuators and said proximity switches are configured to move said perforated pipe in a zig-zag motion in an x-y plane.

8. The system of claim 6, wherein said aperture has a diameter of between about 2 and about 10 centimeters, said air stream deflector extends at least 5 cm beyond an edge of the aperture, said lumen has a diameter of between about 2 and about 12 centimeters, and said pipe has a length of between about 4 and about 25 centimeters.

9. The system of claim 6, wherein said lumen has a diameter of between about 2 and about 12 centimeters.

10. The system of claim 6, wherein a sidewall of said perforated pipe includes between about 1 and about 90 percent open space.

11. The system of claim 6, wherein said perforated pipe has a length of between about 4 and about 25 centimeters.

12. A dissipater comprising:

an air stream deflector including a planar body having an aperture; and a perforated pipe having a sidewall defining a lumen, the lumen being aligned with said aperture, wherein the perforated pipe is substantially perpendicular to the planar body, wherein the sidewall includes a plurality of openings, and wherein a central axis of the aperture is perpendicular to a central axis of each opening in the sidewall, whereby said dissipater is operable for a texturized strand to be passed through said aperture and said lumen to remove excess air from a texturizing process.

13. The dissipater of claim 12, wherein said aperture has a diameter of between about 2 and about 10 centimeters, said lumen has a diameter of between about 2 and about 12 centimeters, said perforated pipe has a length of between about 4 and about 25 centimeters, and said sidewall includes between about 1 and about 90 percent open space.

14. A dissipater comprising:

an air stream deflector including an aperture; and a pipe having a lumen aligned with said aperture, wherein said pipe is pivotally mounted to said air stream deflector to provide motion of said pipe in a first direction and wherein said air deflector is pivotally mounted to provide motion of said pipe in a second direction whereby a texturized strand is passed through said aperture and said lumen to remove excess air from a texturizing process.

* * * * *